US007878583B2

(12) United States Patent
Buckavich et al.

(10) Patent No.: US 7,878,583 B2
(45) Date of Patent: Feb. 1, 2011

(54) FOLDABLE HIGH CHAIR

(75) Inventors: Chuck Buckavich, Attleboro, MA (US); Joseph Brewin, Franklin, MA (US)

(73) Assignee: Cosco Management, Inc., Wilmington, DE (US)

( * ) Notice: Subject to any disclaimer, the term of this patent is extended or adjusted under 35 U.S.C. 154(b) by 74 days.

(21) Appl. No.: 12/407,612

(22) Filed: Mar. 19, 2009

(65) Prior Publication Data

US 2010/0237666 A1 Sep. 23, 2010

(51) Int. Cl.
*A47D 1/02* (2006.01)
*A47D 15/00* (2006.01)

(52) U.S. Cl. ..... 297/46; 297/30; 297/35; 297/467

(58) Field of Classification Search ..... 297/16.1, 297/30, 35, 46, 467
See application file for complete search history.

(56) References Cited

U.S. PATENT DOCUMENTS

| | | | | |
|---|---|---|---|---|
| 2,473,991 | A * | 6/1949 | Felsher | 297/35 |
| 4,768,825 | A * | 9/1988 | Quinlan, Jr. | 297/39 |
| 4,938,603 | A | 7/1990 | Turner et al. | |
| 5,165,755 | A | 11/1992 | Rho | |
| 5,332,241 | A | 7/1994 | Rho | |
| 6,719,371 | B2 | 4/2004 | Yoshie et al. | |
| 6,854,800 | B2 | 2/2005 | Perego | |
| 7,029,064 | B2 | 4/2006 | Chen | |
| 7,128,367 | B2 | 10/2006 | You et al. | |
| 2006/0125293 | A1 | 6/2006 | Yeh | |
| 2006/0220349 | A1 | 10/2006 | Wolf et al. | |

* cited by examiner

*Primary Examiner*—Milton Nelson, Jr.
(74) *Attorney, Agent, or Firm*—Barnes & Thornburg LLP

(57) ABSTRACT

A foldable high chair in accordance with the present disclosure includes a juvenile seat and a seat foundation. The juvenile seat is mounted for movement on the seat foundation during folding and unfolding of the foldable high chair.

16 Claims, 7 Drawing Sheets

FOLDABLE HIGH CHAIR

BACKGROUND

The present disclosure relates to a juvenile high chair and, in particular, to a foldable high chair. More particularly, the present disclosure relates to a foldable high chair that includes a lock that can be operated to retain the foldable high chair in an unfolded orientation.

SUMMARY

A foldable high chair in accordance with the present disclosure includes a juvenile seat and a seat foundation. The juvenile seat is mounted for movement on the seat foundation during folding and unfolding of the foldable high chair.

In illustrative embodiments, the seat foundation includes a front leg unit pivotably coupled to a rear leg unit and a juvenile seat pivotably coupled to the front leg unit and slidably coupled to the rear leg unit. The juvenile seat includes a seat back that is slidably coupled to rear legs included in the rear leg unit and a footrest unit that is pivotably coupled to the seat back and to front legs included in the front leg unit. The juvenile seat also includes an armrest unit and a seat bottom, each of which is pivotably coupled to the seat back and to the front legs included in the front leg unit. These couplings function to allow controlled movement of the juvenile seat relative to the seat foundation during folding and unfolding of the high chair so that a caregiver can transform the high chair from an expanded use position to a flat-fold collapsed position. A releasable seat lock is provided to lock the juvenile seat to the seat foundation in each of the expanded use and flat-fold collapsed positions.

Also in illustrative embodiments, the high chair further includes an extensible crotch bar pivotably coupled to each of the armrest unit and the seat bottom. The extensible crotch bar is configured to lengthen during unfolding of the high chair and shorten during folding of the high chair.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
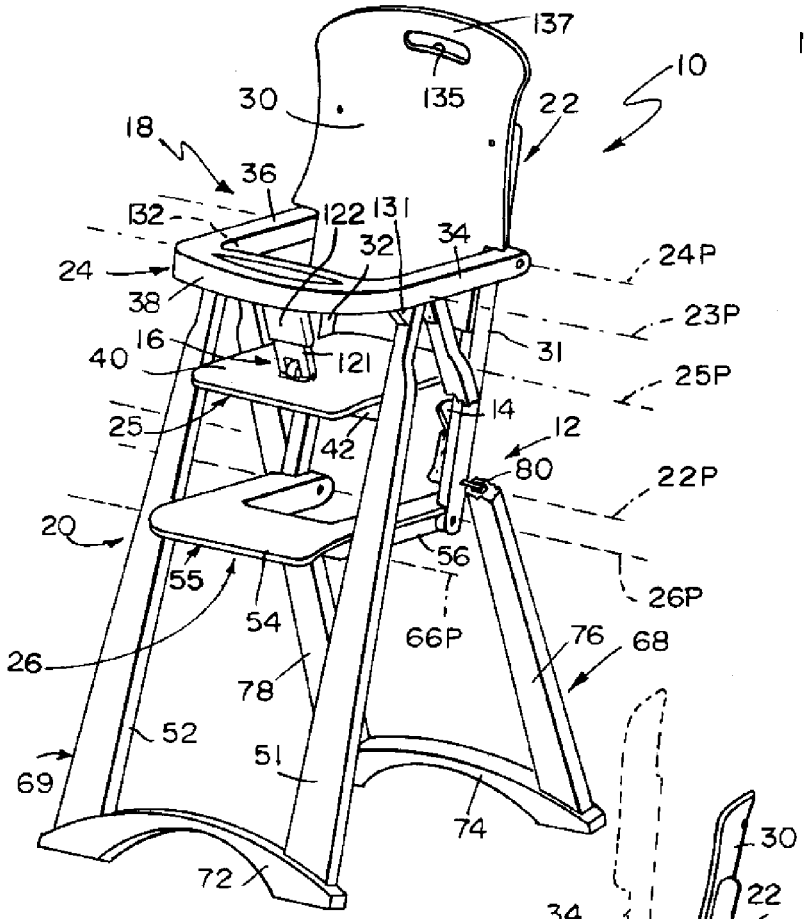
FIG. 1 is a perspective view of a collapsible flat-fold high chair in accordance with the present disclosure showing the high chair in an expanded use position, with a portion of one of the rear legs broken away to reveal an anchor included in a seat lock provided in the high chair and arranged to lock a juvenile seat included in the high chair to a seat foundation included in the high chair.
Figure 3:
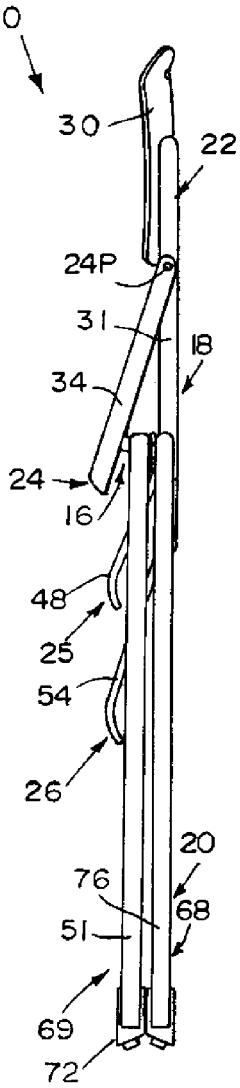
FIG. 3 is a side elevation view similar to FIG. 2 showing the collapsible flat-fold high chair of FIG. 1 after it has been folded to assume a flat-fold collapsed storage position.
Figure 2:
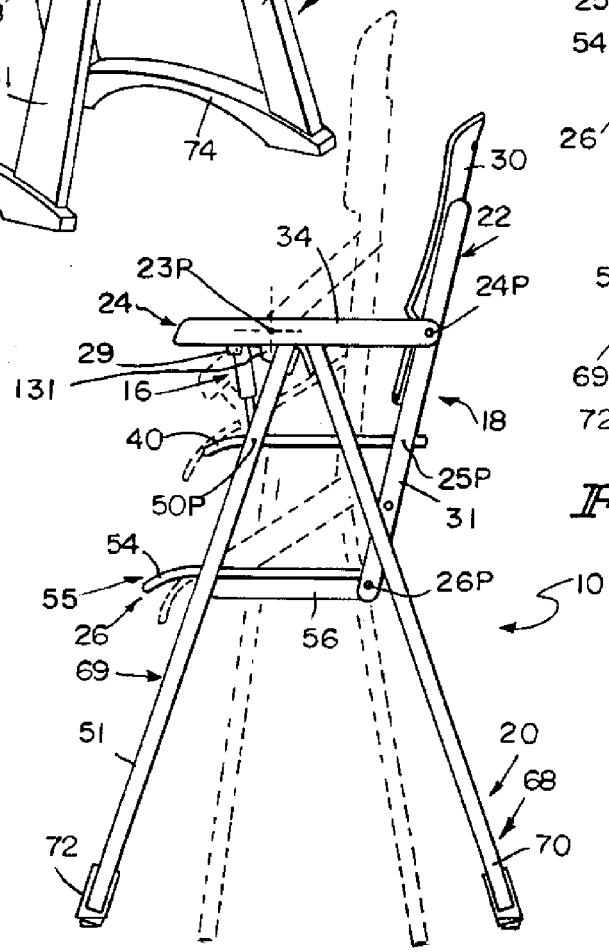
FIG. 2 is a side elevation view of the flat-fold high chair of FIG. 1 showing a first stage (in phantom) of controlled collapse of the high chair during transformation of the high chair from the expanded use position of FIG. 1 to the flat-fold collapsed position of FIG. 3.
Figure 5:
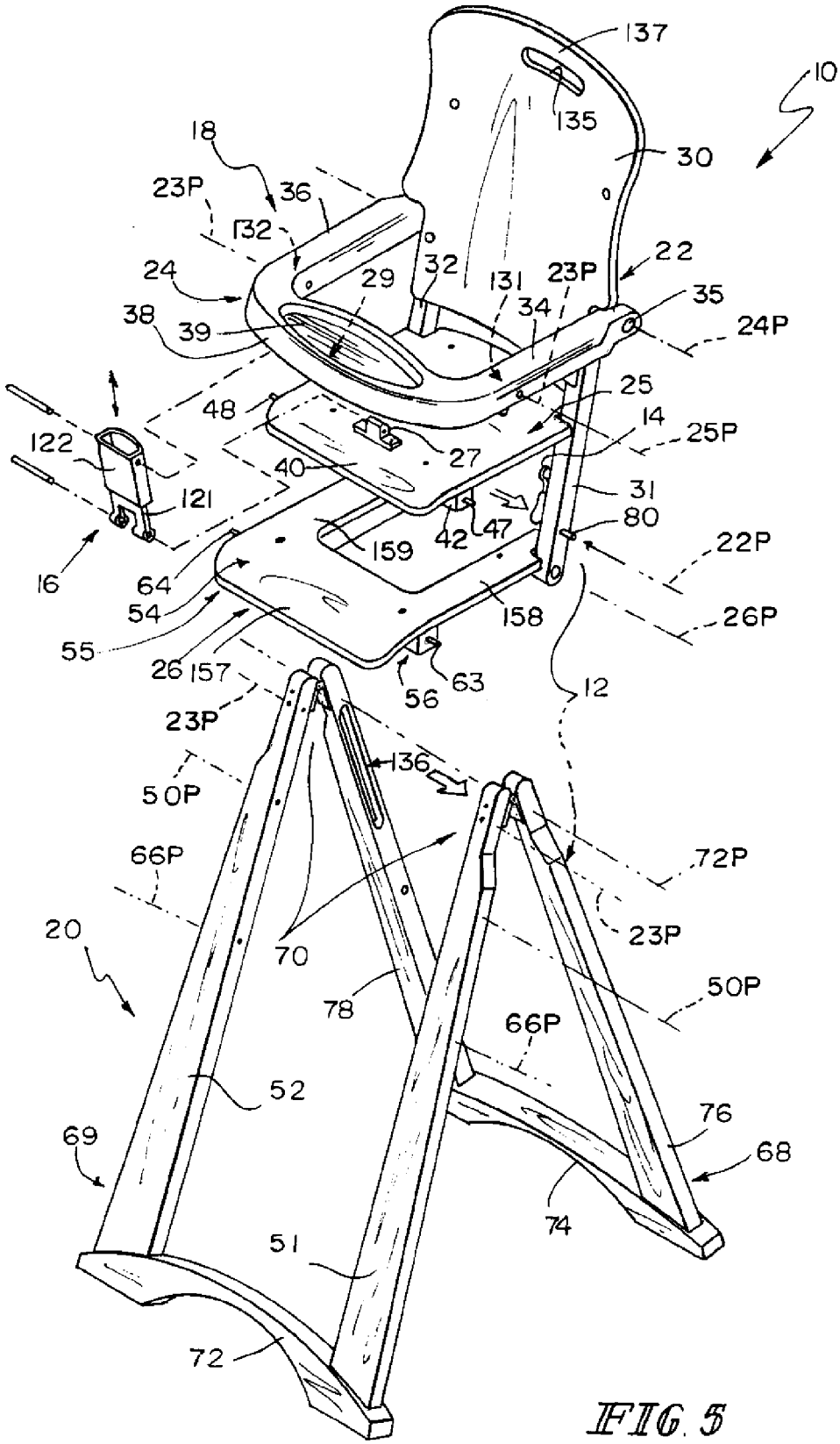
FIG. 5 is an exploded perspective view similar to FIG. 4 illustrating several subassemblies included in the collapsible flat-fold high chair of FIGS. 1-4 and showing a juvenile seat (subassembly) comprising a seat back, an armrest unit mounted for pivotable movement on the seat back, a seat bottom arranged to underlie the armrest unit and mounted for pivotable movement on the seat back, and a footrest unit arranged to underlie the armrest unit and mounted for pivotable movement on the seat back, a seat foundation (subassembly) comprising a rear leg unit, a front leg unit, and a leg-unit pivot configured to support the rear and front leg units for pivotable movement relative to one another, and an extensible crotch bar (subassembly) comprising a lower section coupled to the seat bottom and an upper section coupled to the armrest unit and arranged to mate with and slide relative to the lower section during folding and unfolding of the collapsible flat-fold high chair as suggested in FIGS. 6-8.
Figure 6:
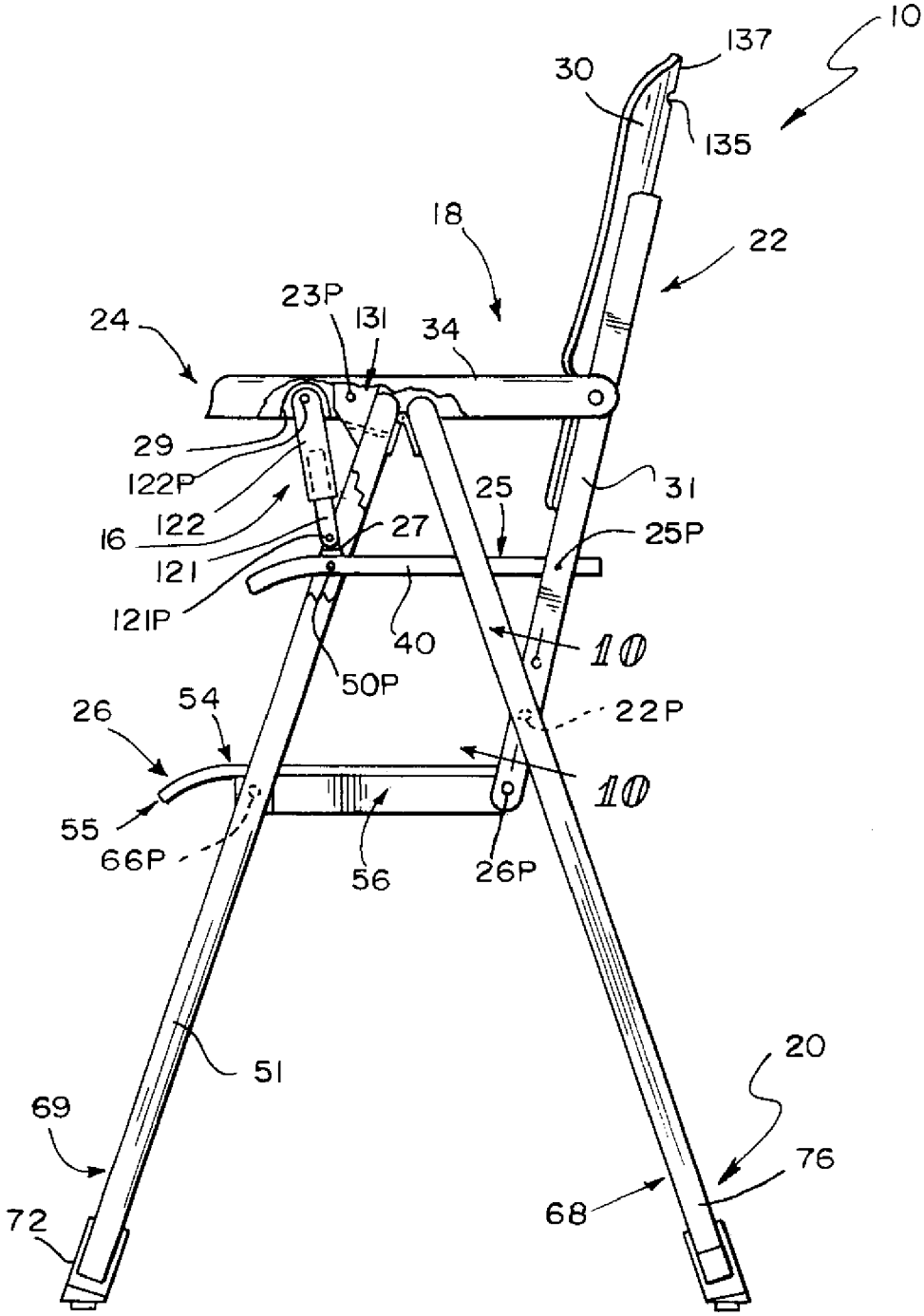
FIG. 6 is an enlarged side elevation view similar to FIG. 1 showing the extensible crotch bar in a fully extended position upon unfolding of the high chair to assume the expanded use position.
Figure 7:
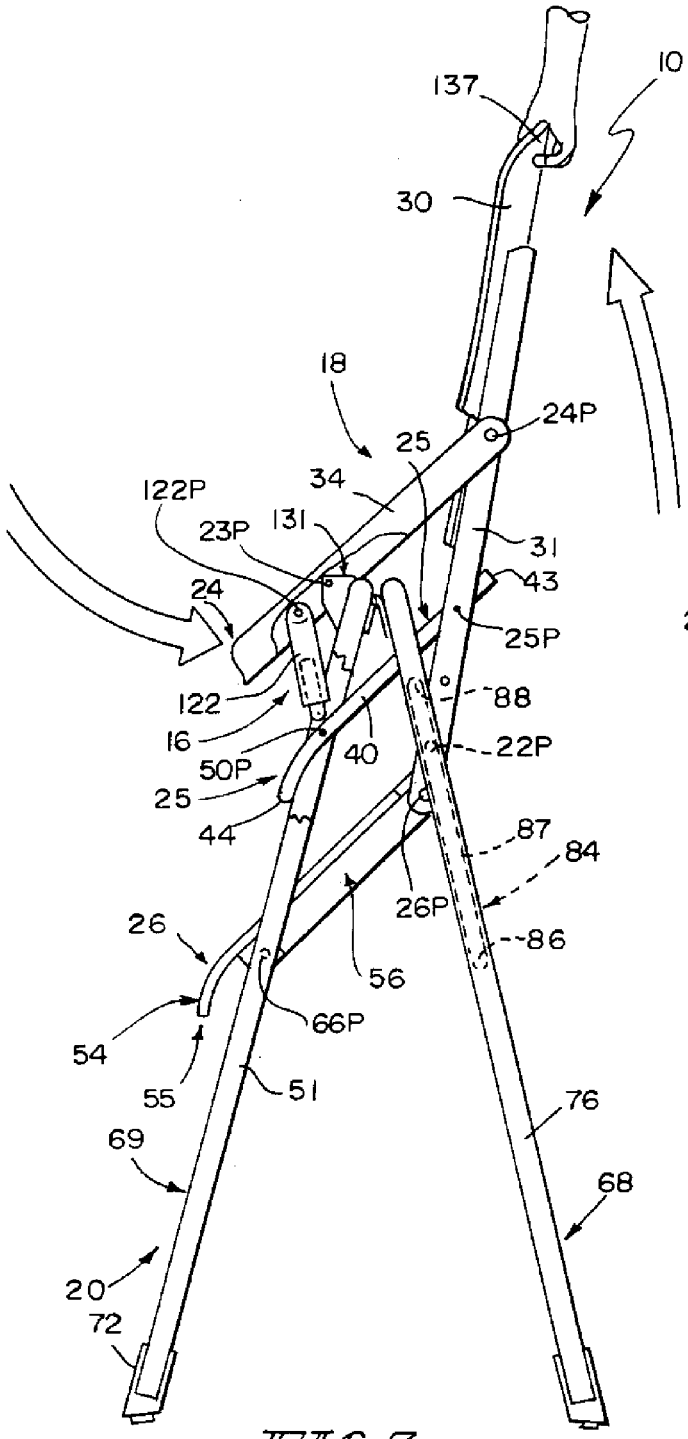
FIG. 7 is a view similar to FIG. 6 showing the extensible crotch bar in a partly extended position during a first stage of folding of the high chair.
Figure 8:
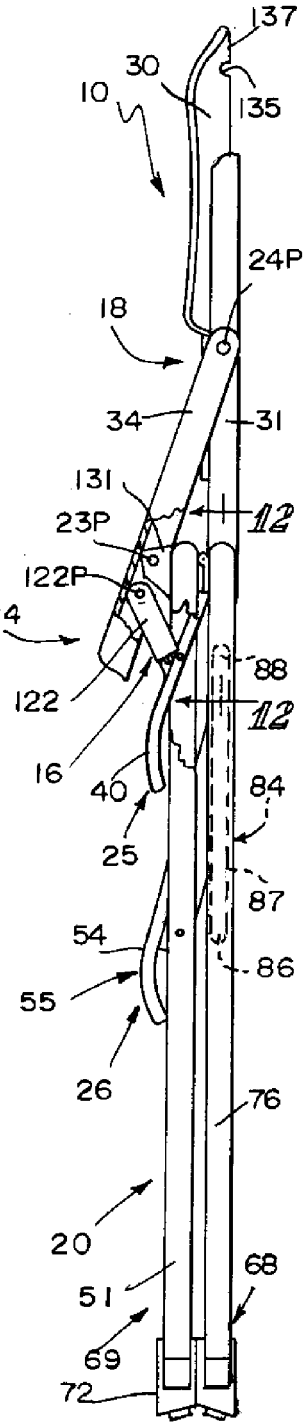
FIG. 8 is a view similar to FIGS. 6 and 7 showing the extensible crotch bar in a non-extended position upon folding movement of the high chair to assume the flat-fold collapsed storage position.
Figure 12:
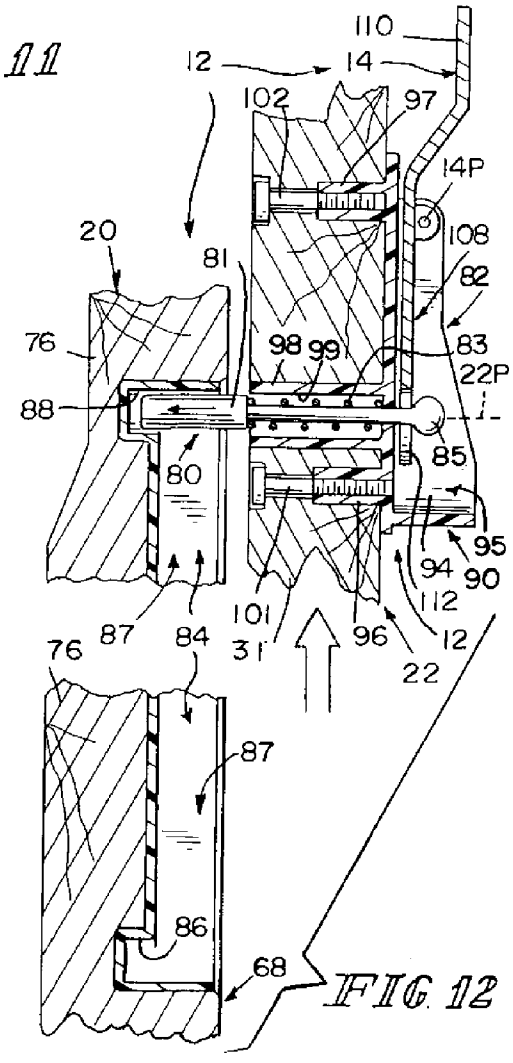
FIG. 12 is a sectional view similar to FIGS. 10 and 11 showing arrival of the rising seat back at an elevated position when the high chair has been moved to assume the collapsed storage position and spring-biased movement of the motion-blocker post into an upper anchor-receiver socket included in the anchor-receiver unit so as to block movement of the juvenile seat relative to the seat foundation once the high chair has been folded to assume the collapsed storage position.
Figure 11:
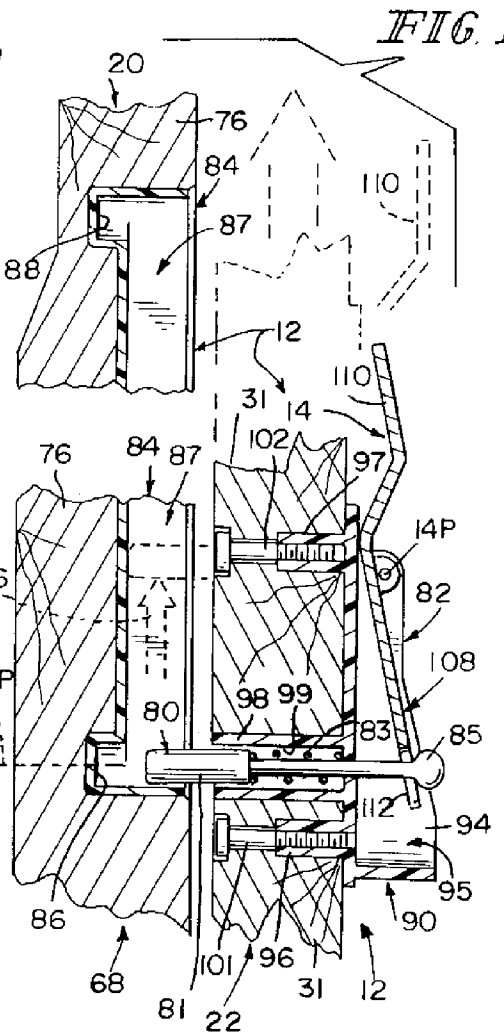
FIG. 11 is a sectional view similar to FIG. 10 showing pivoting movement of the lever included in the anchor-release unit to retract the motion-blocker post from the lower anchor-receiver socket (against a biasing force generated by the spring) to free the juvenile seat to be moved relative to the seat foundation as suggested by the phantom lines included in FIG. 11 to raise the seat back upwardly relative to the seat foundation.

A high chair 10 in accordance with the present disclosure is configured to be folded easily by a caregiver so that it can be transformed from an expanded use position shown in FIG. 1 to a flat-fold collapsed storage position shown in FIG. 3 in an illustrative manner shown in FIGS. 1-3 and 6-8. High chair 10 includes a seat lock 12 suggested in FIGS. 1, 5, and 9 that is configured to be operated by a caregiver to retain (i.e., lock) high chair 10 either in the expanded use position as shown in FIGS. 6 and 10 or in the flat-fold collapsed position as shown in FIGS. 8 and 12 in response to movement of a lever 14 included in seat lock 12 as suggested in FIG. 11. High chair 10 also includes an extensible crotch bar 16 that is configured to lengthen and shorten during transformation of high chair from one position to another as suggested in FIGS. 6-8.

As suggested in FIGS. 1 and 5, in an illustrative embodiment, high chair 10 comprises several subassemblies including extensible crotch bar 16, juvenile seat 18, and seat foundation 20. Each of these subassemblies 16, 18, 20 is collapsible as suggested in FIGS. 6-8 to facilitate transformation of high chair between the expanded use position of FIGS. 1 and 6 and the flat-fold collapsed storage position of FIGS. 3 and 8.

Juvenile seat 18 includes a seat back 22, an armrest unit 24, a seat bottom 25, and a footrest unit 26. Each of armrest unit 24, seat bottom 25, and footrest unit 26 are mounted for pivotable movement on seat back 22 as suggested in FIGS. 6-8 to facilitate folding and unfolding of high chair 10. Armrest unit 24 is mounted to pivot relative to seat back 22 about an armrest pivot axis 24P as suggested in FIGS. 1, 5, and 6-8. Seat bottom 25 is mounted to pivot about a rear seat bottom pivot axis 25P as suggested in FIGS. 2, 5, and 6-8. Footrest unit 26 is mounted to pivot relative to seat back 22 about a rear footrest pivot axis 26P as also suggested in FIGS. 1, 5, and 6-8.

Figures 4, 4A:
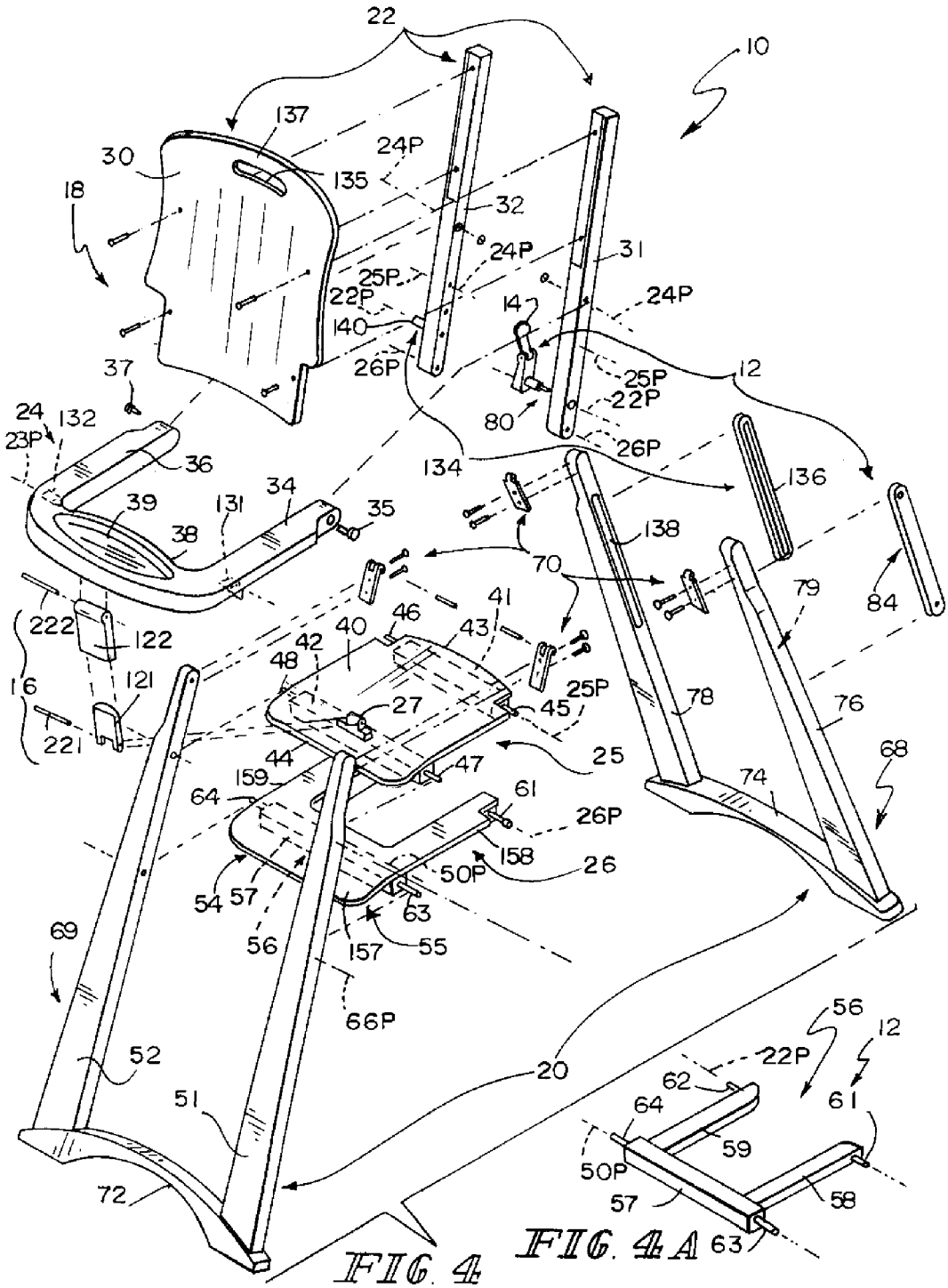
FIG. 4 is an exploded perspective assembly view of the components that cooperate to form the collapsible flat-fold high chair of FIGS. 1-3.
FIG. 4A is an enlarged perspective view of a foot-deck support included in a footrest unit included in a juvenile seat included in the collapsible flat-fold high chair shown in FIG. 4.

Seat back 22 includes a backrest 30 coupled to first and second backrest supports 31, 32 as suggested in FIGS. 4 and 5. In the illustrated embodiment, first and second backrest supports 31, 32 are arranged to lie in spaced-apart parallel relation to one another and are coupled to backrest 30 using any suitable means. Backrest 30 is formed to include a finger-receiving opening 135 located to form a carry handle 137 as suggested in FIGS. 1 and 7. Armrest unit 24 is mounted on middle portions of first and second backrest supports 31, 32 for pivotable movement about armrest pivot axis 24P as suggested in FIG. 4. Footrest unit 26 is mounted on lower portions of first and second backrest supports 31, 32 for pivotable movement about rear footrest pivot axis 26P as also suggested in FIG. 4. Seat bottom 25 is mounted on portions of first and second backrest supports 31, 32 for pivotable movement about rear seat bottom pivot axis 25P and to establish pivot axis 25P in a location between pivot axes 24P and 26P as suggested in FIGS. 2 and 7.

Armrest unit 24 includes a first arm 34, a first inner arm pivot 35, a second arm 36, a second inner arm pivot 37, and a rail 38 as suggested in FIGS. 1, 4, and 5. First arm 34 is coupled at an inner end thereof to first backrest support 31 by first inner arm pivot 35 for pivotable movement about armrest pivot axis 24P. Second arm 36 is coupled at an inner end thereof to second backrest support 32 by second inner arm pivot 37 for pivotable movement about armrest pivot axis 24P. Front bridge 38 is arranged to interconnect free ends of first and second arms 34, 36 so as to pivot about armrest pivot axis 24P during pivotable movement of first and second arms 34, 36 about armrest pivot axis 24P caused by folding and unfolding of high chair 10. In an illustrative embodiment, front bridge 38 is configured to provide a small tray formed to include article-receiving cavity 39. As suggested in FIG. 4, first arm 34, front bridge 38, and second arm 36 are arranged in series to form a monolithic U-shaped member that is able to pivot about armrest pivot axis 24P during folding and unfolding of high chair 10. It is within the scope of this disclosure to provide a larger tray (not shown) that is configured to mount on armrest unit 24 and pivot therewith about pivot axis 24P during folding and unfolding of high chair 10.

Seat bottom 25 includes a bottom plate 40 coupled to first and second bottom-plate supports 41, 42 that are arranged to underlie bottom plate 40 as suggested in FIG. 4. First bottom-plate support 41 is arranged to extend along a rear edge 43 of bottom plate 40 and lie between first and second backrest supports 31, 32 as suggested in FIGS. 4 and 5. Second bottom-plate support 42 is arranged to extend along a front edge 44 of bottom plate 40 and lie in spaced-apart parallel relation to first bottom-plate support 42 as suggested in FIG. 4. Seat bottom 25 also includes a first rear pivot axle 45 coupled to one end of first bottom-plate support 41 and to a middle portion of first backrest support 31 at rear seat bottom pivot axis 25P and a second rear pivot axle 46 coupled to an opposite end of first bottom-plate support 41 and to a middle portion of second backrest support 32 at rear seat bottom pivot axis 25P as suggested in FIGS. 4 and 5. Seat bottom 25 further includes a first front pivot axle 47 coupled to one end of second bottom-plate support 42 and to a first front leg 51 included in seat foundation 20 at a front seat bottom pivot axis 50P and a second front pivot axle 48 coupled to an opposite end of second bottom-plate support 42 and to a second front leg 52 included in seat foundation 20 at front seat bottom pivot axis 50P.

Footrest unit 26 includes a foot deck 54, a foot-deck support 56 underlying foot deck 54, and four pivot axles 61, 62, 63, and 64 coupled to foot-deck support 56 and arranged to be coupled to seat back 22 as suggested in FIGS. 4 and 4A. Foot deck 54 is coupled to foot-deck support 56 to provide a foot platform 55 arranged to lie under seat bottom 25 when high chair 10 is unfolded to assume the expanded use position as suggested in FIG. 1.

As shown in FIG. 4A, foot-deck support 56 of platform 55 includes a front rail 57 and first and second side rails 58, 59 that are arranged to lie in spaced-apart parallel relation to one another end are coupled to front rail 57 to form a substantially U-shaped foot-deck support 56. A first rear pivot axle 61 is associated with one side of a free end of first side rail 58 and a second rear pivot axle 62 is coupled to one side of a free end of second side rail 58 as suggested in FIG. 4A. First and second rear pivot axles 61, 62 are configured to mate with lower portions of first and second backrest supports 31, 32 included in seat back 22 along rear footrest pivot axis 26P as suggested in FIGS. 4 and 5. A first front pivot axle 63 is coupled to one end of front rail 57 and a second front pivot axle 63 is coupled to an opposite end of front rail 57 as suggested in FIGS. 4 and 4A. First and second front pivot axles 63, 64 are configured to mate with lower portions first and second front legs 51, 52 included in seat foundation 20 along a front footrest pivot axis 66P as suggested in FIGS. 1, 4, and 6 to facilitate pivotable movement of footrest unit 26 relative to seat foundation 20 during folding and unfolding of high chair 10.

Foot deck 54 is a monolithic U-shaped member in an illustrative embodiment shown, for example, in FIGS. 4 and 5. Foot deck 54 includes a front plate 157 coupled to underlying front rail 57, a first side plate 158 coupled to underlying first side rail 58, and a second side plate 159 coupled to underlying second side rail 59.

Seat foundation 20 includes a rear leg unit 68, a front leg unit 69, and a leg-pivot unit 70 as suggested in FIGS. 4 and 5. Leg-pivot unit 70 is coupled to rear and front leg units 68, 69 to support rear leg unit 68 for pivotable movement about pivot axis 72P relative to front leg unit 68 during folding and unfolding of high chair 10 as suggested in FIGS. 6-8.

Front leg unit 69 includes a front floor rail 72 adapted to rest on a floor underlying high chair 10, a first front leg 51 extending upwardly from one end of front floor rail 72, and a second front leg 52 extending upwardly from another end of front floor ail 72 as suggested in FIGS. 1, 4, and 5. Front leg unit 69 has a somewhat U-shaped configuration in the illustrated embodiment.

As suggested in FIG. 4, first front pivot axle 47 of seat bottom 25 is arranged to extend into an aperture formed in an upper portion of first front leg 51 and second front pivot axle 49 of seat bottom 25 is arranged to extend into a confronting aperture formed in an upper portion of second front leg 52 to support a front portion of seat bottom 25 for pivotable movement about front seat bottom pivot axis 50P during folding and unfolding of high chair 10. As also suggested in FIG. 4, first front pivot axle 63 of footrest unit 26 is arranged to extend into an aperture formed in a middle portion of first front leg 51 and second front pivot axle 64 of footrest unit 26 is arranged to extend into a confronting aperture formed in a middle portion of second front leg 52 to support a front portion of foot deck 54 of platform 55 of footrest unit 26 for pivotable movement about front footrest pivot axis 66P during folding and unfolding of high chair 10.

Armrest unit 24 is coupled to front leg unit 69 to support armrest unit 24 for pivotable movement about a seat pivot axis 23P relative to front leg unit 69 during folding and unfolding of high chair tray as suggested in FIGS. 5 and 6-8. Armrest unit 24 includes a first outer arm pivot 131 pivotably coupled to first front leg 51 of front leg unit 69 at seat pivot axis 23P and a second arm pivot 132 pivotably coupled to second front leg 52 of front leg unit 69 at seat pivot axis 23P. Each of arm pivots 131, 132 illustratively includes a bracket coupled to a companion one of first and second arms 34, 36 and an axle arranged to extend along seat pivot axis 23 to mate with one of arms 34, 36 and a companion front leg 51.52

Rear leg unit 68 includes a rear floor rail 74 adapted to rest on the floor underlying high chair 10, a first rear leg 76 extending upwardly from one end of rear floor rail 74, and a second rear leg 78 extending upwardly from another end of rear floor rail 74 as suggested in FIGS. 1, 4, and 5. Rear leg unit 68 has a somewhat U-shaped configuration in the illustrated embodiment.

As suggested in FIG. 4, first rear pivot axle 45 of seat bottom 25 is arranged to extend into an aperture formed in a lower end of first backrest support 31 and second rear pivot axle 46 of seat bottom 25 is arranged to extend into a confronting aperture formed in the lower end of second backrest support 32 to support a rear portion of seat bottom 25 for pivotable movement about rear seat bottom pivot axis 25P during folding and unfolding of high chair 10. As also suggested in FIG. 4, first front pivot axle 47 of seat bottom 25 is arranged to extend into an aperture formed in an upper end of first front leg 51 of front leg unit 69 and second front pivot axle 48 is arranged to extend into a confronting aperture formed in an upper end of second front leg 52 of front leg unit 69 to support a front portion of seat bottom 25 for pivotable movement about front seat bottom pivot axis 50P during folding and unfolding of high chair 10.

Figure 9:
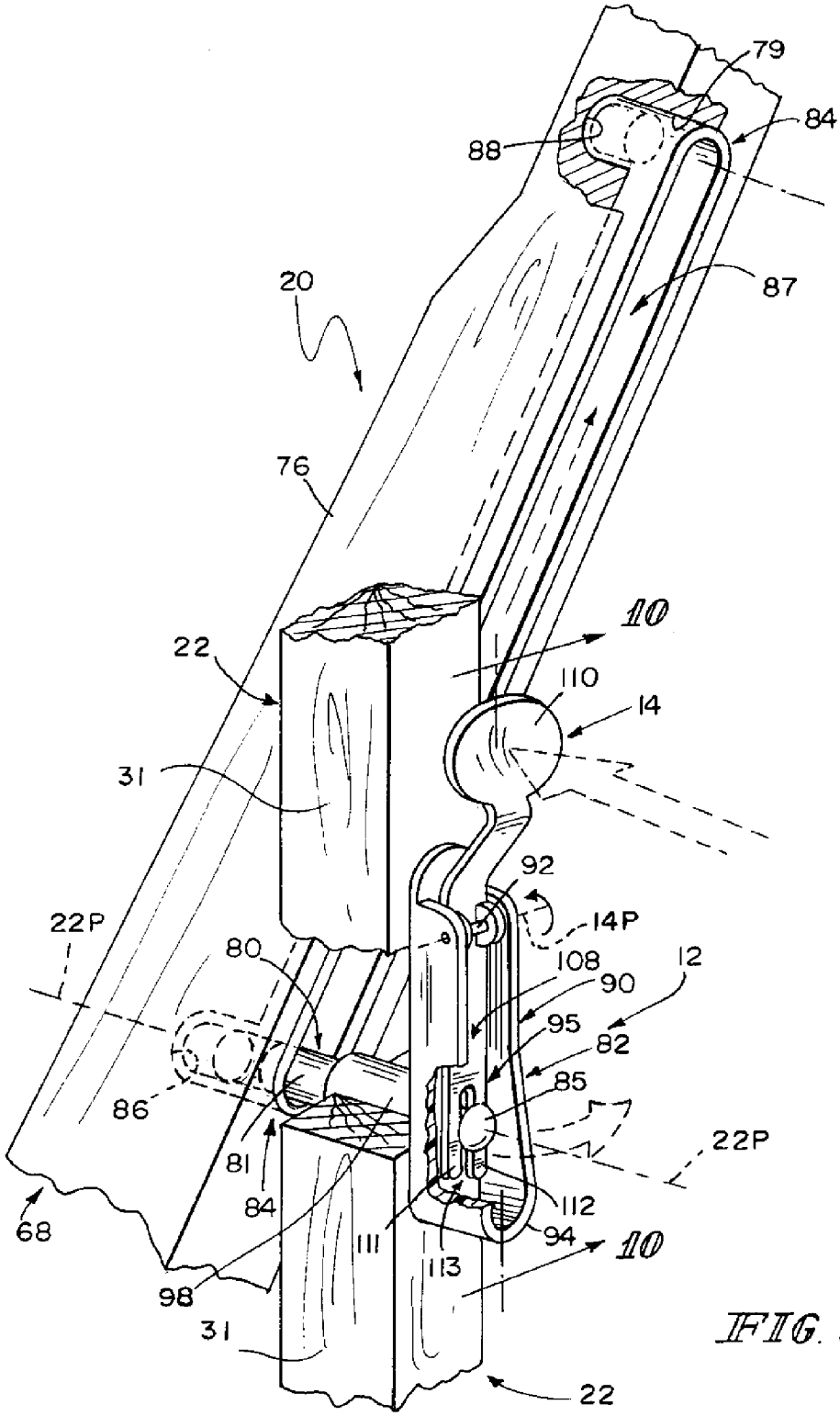
FIG. 9 is an enlarged partial perspective view of a portion of the foundation and the seat back of the collapsible flat fold high chair taken generally in the direction of the double arrows included in FIG. 5 after the juvenile seat subassembly is coupled to the seat foundation subassembly and showing an anchor-release unit including a lever mating with a round head of an anchor and being mounted on a first backrest support of the seat back and showing an elongated anchor-receiver unit being mounted in a first leg of the rear leg unit of the seat foundation, wherein the anchor, anchor-receiver unit, and anchor-release unit cooperate to define a seat lock for locking the juvenile seat to the seat foundation in each of the expanded use and collapsed storage positions of the high chair.
Figure 10:
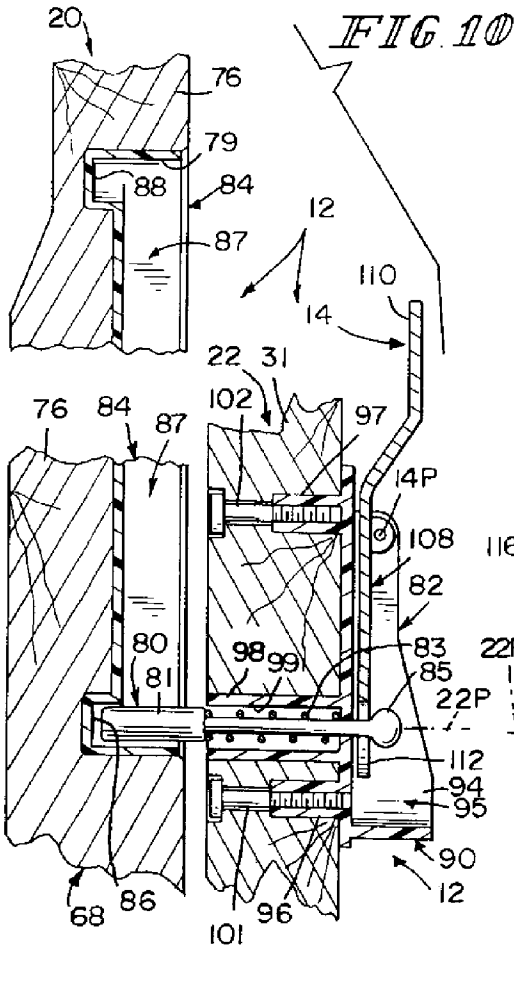
FIG. 10 is a sectional view taken generally along line 10-10 of FIGS. 6 and 9 showing that the anchor of the seat lock includes a movable motion-blocker post and a spring arranged to move the motion-blocker post relative to the seat back to extend into a lower anchor-receiver socket included in the anchor-receiver unit coupled to the seat foundation to block movement of the juvenile seat relative to the seat foundation once the high chair has been unfolded to assume the expanded use position shown in FIGS. 1 and 6.

Seat lock 12 in high chair 10 is configured to provide lock means for automatically and releasably blocking movement of juvenile seat 18 relative to seat foundation 20 in response to unfolding of high chair 10 to assume the expanded use position as suggested in FIGS. 6, 9, and 10 and also in response to folding of high chair 10 to assume the flat-fold collapsed storage position as suggested in FIGS. 8 and 12. Such lock means is released manually by a caregiver (not shown) acting to move lever 14 included in seat lock 12 in general in relation to juvenile seat 18 and seat foundation 20 (and in particular about lever pivot axis 14P as suggested in FIGS. 9 and 10-12).

Seat lock 12 includes an anchor 80, an anchor-release unit 82, and an anchor-receiver unit 84 as suggested in FIGS. 9 and 10-12. Anchor-receiver unit 84 is coupled to first rear leg 76 of seat foundation 20 and is configured to receive a free end of anchor 80 as anchor 80 moves up and down along the length of first rear leg 76 during folding and unfolding of high chair 10 as suggested in FIGS. 10-12.

Anchor-receiver unit 84 is shown, for example, in FIGS. 4 and 9-12 and is configured to be mounted in a cavity 79 formed in first rear leg 36 of seat foundation 20 to receive the free end of anchor 80 during folding and unfolding of high chair 10. Anchor-receiver unit 84 is formed to include a lower anchor-receiver socket 86 at one end thereof, an upper anchor-receiver socket 88 at another end thereof, and an anchor-travel channel 87 interconnecting lower and upper anchor-receiver sockets 86, 88 as suggested in FIGS. 9 and 10. Lower anchor-receiver socket 86 is located to receive and retain anchor 80 therein upon unfolding of high chair 10 to assume the expanded use position as suggested in FIGS. 6, 9, and 10 to retain juvenile seat 18 in a releasable stationary erected position relative to seat foundation 20. Upper anchor-receiver socket 88 is located to receive and retain anchor 80 therein upon folding of high chair 10 to assume the flat-fold collapsed storage position as suggested in FIGS. 8 and 12 to retain juvenile seat 18 in a releasable stationary knock-down position relative to seat foundation 20.

Anchor-release unit 82 includes a rod mount 90 coupled to first backrest support 31 of seat back 22 and a pivot rod 92 coupled to rod mount 90 to establish a lever pivot axis 14P and coupled to lever 14 to support lever 14 for pivotable movement about lever pivot axis 14P as suggested in FIGS. 9 and 10-12. Rod mount 90 includes a lever housing 94 formed to include a cavity 95 receiving a portion of lever 14, a first fastener mount 96 coupled to lever housing 94, a second fastener mount 97 coupled to lever housing 94, and an anchor sleeve 98 coupled to lever housing 94 and arranged to lie between first and second fastener mounts 96, 97 as suggested in FIG. 10. Anchor 80 is sized to extend through and move back and forth in a passageway 99 formed in anchor sleeve 98 as suggested in FIGS. 10-12 during folding and unfolding of high chair 10. A first fastener 101 extends through first backrest support 31 to mate with first fastener mount 96 and a second fastener 102 extends through first backrest support 31 to mate with second fastener mount 97 to retain lever housing 94 in place on first backrest support 31 as suggested in FIGS. 10-12.

Anchor 80 includes a motion-blocker post 81 and an anchor-mover spring 83 arranged to lie in passageway 99 of anchor sleeve 98 as suggested in FIG. 10. Anchor-mover spring 83 is configured to provide means for yieldably urging a free end of motion-blocker post 81 into lower anchor-receiver socket 86 when high chair 10 is unfolded to assume the expanded use position as suggested in FIG. 10 or into upper anchor-receiver socket 88 when high chair 10 is folded to assume the flat-fold collapsed storage position. In an illustrative embodiment, anchor-mover spring 83 is coiled and arranged to wrap around motion-blocker post 81 as suggested in FIG. 10.

High chair 10 also includes a seat guide 134 associated with seat lock 12 as suggested in FIG. 4. Seat guide 134 includes a post-receiver unit 136 mounted in a cavity 138 formed in second rear leg 78 as suggested in FIGS. 4 and 5 to lie in spaced-apart confronting relation to anchor-receiver unit 84 mounted in cavity 79 formed in first rear leg 76. Seat guide 134 also includes a guide post 140 coupled to second backrest support 32 of seat back 22 and arranged to extend into an elongated post-travel channel formed in pin-receiver unit 136 as suggested in FIG. 4. Guide post 140 and motion-blocker post 81 are arranged to lie along pivot axis 224 for upward and downward motion, respectively, in post-travel channels formed in post-receiver unit 136 and anchor-receiver unit 84.

Lever 14 includes an anchor-mover arm 108 coupled to motion-blocker post 81 at one end thereof and an actuator pad 110 at another end thereof as suggested in FIG. 9. Anchor-mover arm 108 includes first and second fingers 111, 112 arranged to lie in spaced-apart relation to one another to form a passageway 113 lying therebetween and receiving a portion 85 of motion-blocker post 81 therein. Fingers 111, 112 are arranged to mate with a round head 85 included in motion-blocker post 81 during pivoting movement of lever 14 as suggested in FIGS. 10 and 11. As suggested in FIG. 9, inward movement of actuator pad 110 in direction 114 causes lever 14 to pivot about pivot axis 14P to move fingers 111, 112 away from lower anchor-receiver socket 86 to move motion-blocker post 81 so that it is withdrawn from lower anchor-receiver socket 86 to compress anchor-mover spring 83 a suggested in FIG. 11.

Now high chair 10 is unlocked and can be folded to assume the flat-fold collapsed storage position. During such folding, the free end of motion-blocker post 81 moves upwardly in anchor-travel channel in direction 116 toward upper anchor-receiver socket 88 as suggested in FIG. 1. Once high chair 10 has been folded fully to assume its flat-fold collapsed storage position, anchor-mover spring 83 acts against motion-blocker post 81 and lever housing 94 to urge the free end of motion-blocker post 81 into upper anchor-receiver socket 88 to lock juvenile seat 18 to seat foundation 20 whenever high chair 10 is in the flat-fold collapsed position as suggested in FIG. 12.

Crotch bar 16 is extensible and comprises a lower section 121 coupled to seat bottom 25 and an upper section 122 coupled to armrest unit 24 as suggested in FIG. 1. In an illustrative embodiment, seat bottom 25 further includes a lower bar mount 27 (see FIG. 4) coupled to a top surface of bottom plate 40 and pivotably coupled to lower section 121 using pivot rod 221 (FIG. 4) to support lower section 121 for pivotable movement about pivot axis 121P relative to seat bottom 25 during folding and unfolding of high chair 10. Also in an illustrative embodiment, armrest unit 24 further includes an upper bar mount 29 (see FIGS. 2 and 6) coupled to an underside of front bridge 38 and pivotably coupled to upper section 122 using pivot rod 222 (FIG. 4) to support upper section 122 for pivotable movement about pivot axis 122P relative to armrest unit 24 during folding and unfolding of high chair 10.

In an illustrative embodiment, lower and upper sections 121, 122 of extensible crotch bar 116 mate in telescoping relation with one another as suggested in FIGS. 4, 5, and 6-8. Extensible crotch bar 16 is shown in a fully extended position in FIG. 6 upon unfolding of high chair 10 to assume the expanded use position. Extensible crotch bar 16 is shown in a partly extended position in FIG. 7 during a first stage of folding of high chair 10. Extensible crotch bar 16 is shown in a non-extended position in FIG. 8 upon folding movement of high chair 10 to assume the flat-folded collapsed storage position.

The partial perspective view illustrated in FIG. 9 is of a portion of seat foundation 20 and seat back 22 of collapsible flat fold high chair 10 taken generally in the direction of the double arrows included in FIG. 5 after juvenile seat 18 is coupled to seat foundation 20. Anchor-release unit 82 includes a lever 14 mating with round head 85 of anchor 80. Lever 14 is mounted on first backrest support 31 of seat back 14. An elongated anchor-receiver unit 84 is mounted in first leg 76 of rear leg unit 69 of seat foundation 20. Anchor 80, anchor-receiver unit 84, and anchor-release unit 82 cooperate to define a seat lock 12 for locking juvenile seat 18 to seat foundation 20 in each of the expanded use and collapsed storage positions of high chair 10.

As suggested in FIG. 10, anchor 80 of seat lock 12 includes movable motion-blocker post 81 and a spring 83 arranged to move motion-blocker post 81 relative to seat back 14 to extend into a lower anchor-receiver socket 86 included in anchor-receiver unit 84 coupled to seat foundation 20 to block movement of juvenile seat 18 relative to seat foundation 20 once high chair 10 has been unfolded to assume the expanded use position shown in FIGS. 1 and 6. As suggested in FIG. 11, pivoting movement of lever 14 included in anchor-release unit 84 operates to retract motion-blocker post 81 from lower anchor-receiver socket 86 (against a biasing force generated by spring 83) to free juvenile seat 18 to be moved relative to seat foundation 20 as suggested by the phantom lines included in FIG. 11 to raise seat back 14 upwardly relative to seat foundation 20. As suggested in FIG. 12, rising seat back 14 arrives at an elevated position when high chair 10 has been moved to assume the collapsed storage position. Motion-blocker post 81 is moved by spring 83 into upper anchor-receiver socket 88 included in anchor-receiver unit 24 so as to block movement of juvenile seat 18 relative to seat foundation 20 once high chair 10 has been folded to assume the collapsed storage position.

The invention claimed is:

1. A foldable high chair comprising a seat foundation including a front leg unit and a rear leg unit coupled to the front leg unit for pivotable movement about a leg pivot axis between a spread-apart position wherein a floor-engaging portion of the front leg unit is separated from a floor-engaging portion of the rear leg unit and a drawn-together position wherein the floor-engaging portions of the front and rear leg units lie in close proximity to one another and a juvenile seat mounted for movement on the seat foundation between an erected position and a knock-down position during pivotable movement of the front leg unit relative to the rear leg unit corresponding to folding and unfolding of the foldable high chair, wherein the juvenile seat is coupled to the front leg unit for pivotable movement about a seat pivot axis and to the rear leg unit for sliding movement along a portion of the rear leg unit in response to movement of the juvenile seat between the erected position and the knock-down position to cause the juvenile seat to assume the erected position and the seat foundation to assume the spread-apart position upon unfolding of the foldable high chair to assume an expanded use position and to cause the juvenile seat to assume the knock-down position and the seat foundation to assume the drawn-together position upon folding of the foldable high chair to assume a flat-fold collapsed storage position, wherein the juvenile seat includes a seat back coupled to the rear leg unit for sliding along the portion of the rear leg unit, an armrest unit coupled to the front leg unit for pivotable movement about the seat pivot axis and coupled to the seat back for pivotable movement about an armrest pivot axis, and a seat bottom coupled to the seat back for pivotable movement about a rear seat bottom pivot axis and coupled to the front leg unit for pivotable movement about a front seat bottom pivot axis.

2. The foldable high chair of claim 1, wherein the armrest unit includes a first arm coupled at an inner end thereof to the seat back by a first inner arm pivot for pivotable movement about the armrest pivot axis, a first outer arm pivot coupled to an outer end of the first arm and pivotably coupled to a first front leg included in the front leg unit at the seat pivot axis, a second arm coupled at an inner end thereof to the seat back by a second inner arm pivot for pivotable movement about the armrest pivot axis, and a second outer arm pivot coupled to an outer end of the second arm and pivotably coupled to a second front leg included in the front leg unit at the seat pivot axis.

3. The foldable high chair of claim 1, wherein the juvenile seat further includes a footrest unit coupled to the seat back for pivotable movement about a rear footrest pivot axis and coupled to the front leg unit for pivotable movement about a front footrest pivot axis.

4. The foldable high chair of claim 3, wherein the seat back includes first and second backrest supports arranged to lie in spaced-apart relation to one another and a backrest coupled to each of the first and second backrest supports, the armrest unit is coupled to each of the first and second backrest supports at the armrest pivot axis, the seat bottom is coupled to each of the first and second backrest supports at the rear seat bottom pivot axis, and the footrest unit is coupled to each of the first and second backrest supports at the rear footrest pivot axis.

5. The foldable high chair of claim 4, wherein the seat back further includes an anchor coupled to the first backrest support and arranged to extend into an anchor-travel channel formed in the portion of the rear leg unit and the anchor is located on the first backrest support in a position between the rear seat bottom pivot axis and the rear footrest pivot axis and is arranged to move back and forth in the anchor-travel channel toward and away from the leg pivot axis in response to movement of the seat foundation between the spread-apart and drawn-together positions.

6. The foldable high chair of claim 1, wherein the seat back includes first and second backrest supports and a backrest coupled to each of the first and second backrest supports, the armrest unit is coupled to each of the first and second backrest supports, and the seat bottom is coupled to each of the first and second backrest supports.

7. The foldable high chair of claim 6, wherein the seat back further includes an anchor coupled to the first backrest support and arranged to extend into an anchor-travel channel formed in the portion of the rear leg unit and the anchor is arranged to move back and forth in the anchor-travel channel toward and away from the leg pivot axis in response to movement of the seat foundation between the spread-apart and drawn-together positions.

8. The foldable high chair of claim 6, further comprising a seat lock configured to provide lock means automatically and releasably blocking movement of the juvenile seat relative to the seat foundation in response to unfolding of the high chair to assume the expanded use position and to folding of the high chair to assume the flat-fold collapsed storage position, wherein the seat lock includes an anchor, a lower anchor-receiver socket formed in the rear leg unit to communicate with an anchor-travel channel formed in the portion of the rear leg unit and to receive the anchor therein upon movement of the high chair to assume the expanded use position, and an upper anchor-receiver socket formed in the rear leg unit to lie in a position located between the lower anchor-receiver socket and the leg pivot axis to communicate with the anchor-travel channel and to receive the anchor therein upon movement of the high chair to assume the flat-fold collapsed storage position.

9. A foldable high chair comprising a seat foundation including a front leg unit and a rear leg unit coupled to the front leg unit for pivotable movement about a leg pivot axis between a spread-apart position wherein a floor-engaging portion of the front leg unit is separated from a floor-engaging portion of the rear leg unit and a drawn-together position wherein the floor-engaging portions of the front and rear leg units lie in close proximity to one another and a juvenile seat mounted for movement on the seat foundation between an erected position and a knock-down position during pivotable movement of the front leg unit relative to the rear leg unit corresponding to folding and unfolding of the foldable high chair, wherein the juvenile seat is coupled to the front leg unit for pivotable movement about a seat pivot axis and to the rear leg unit for sliding movement along a portion of the rear leg unit in response to movement of the juvenile seat between the erected position and the knock-down position to cause the juvenile seat to assume the erected position and the seat foundation to assume the spread-apart position upon unfolding of the foldable high chair to assume an expanded use position and to cause the juvenile seat to assume the knock-down position and the seat foundation to assume the drawn-together position upon folding of the foldable high chair to assume a flat-fold collapsed storage position, wherein the juvenile seat includes a seat back coupled to the rear leg unit for sliding along the portion of the rear leg unit and an armrest unit including a first arm coupled at an inner end thereof to the seat back by a first inner arm pivot for pivotable movement about an armrest pivot axis, a first outer arm pivot coupled to an outer end of the first arm and pivotably coupled to a first front leg included in the front leg unit at the seat pivot axis, a second arm coupled at an inner end thereof to the seat back by a second inner arm pivot for pivotable movement about the armrest pivot axis, and a second outer arm pivot coupled to an outer end of the second arm and pivotably coupled to a second front leg included in the front leg unit at the seat pivot axis.

10. A foldable high chair comprising a seat foundation including a front leg unit and a rear leg unit coupled to the front leg unit for pivotable movement about a leg pivot axis between a spread-apart position wherein a floor-engaging portion of the front leg unit is separated from a floor-engaging portion of the rear leg unit and a drawn-together position wherein the floor-engaging portions of the front and rear leg units lie in close proximity to one another and a juvenile seat mounted for movement on the seat foundation between an erected position and a knock-down position during pivotable movement of the front leg unit relative to the rear leg unit corresponding to folding and unfolding of the foldable high chair, wherein the juvenile seat is coupled to the front leg unit for pivotable movement about a seat pivot axis and to the rear leg unit for sliding movement along a portion of the rear leg unit in response to movement of the juvenile seat between the erected position and the knock-down position to cause the juvenile seat to assume the erected position and the seat foundation to assume the spread-apart position upon unfolding of the foldable high chair to assume an expanded use position and to cause the juvenile seat to assume the knock-down position and the seat foundation to assume the drawn-together position upon folding of the foldable high chair to assume a flat-fold collapsed storage position, further comprising a seat lock configured to provide lock means automatically and releasably blocking movement of the juvenile seat relative to the seat foundation in response to unfolding of the high chair to assume the expanded use position and to folding of the high chair to assume the flat-fold collapsed storage position.

11. The foldable high chair of claim 10, wherein the seat lock includes an anchor coupled to the juvenile seat to move therewith relative to the seat foundation and an anchor-receiver unit coupled to the rear leg unit and configured to receive a free end of the anchor and to allow movement of the free end of the anchor therein during movement of the juvenile seat relative to the seat foundation.

12. The foldable high chair of claim 11, wherein the anchor-receiver unit is formed to include a lower anchor-receiver socket, an upper anchor-receiver socket, and an anchor-travel channel interconnecting the lower and upper anchor-receiver sockets, the lower anchor-receiver socket is located to receive and retain the free end of the anchor therein upon unfolding of the high chair to assume the expanded use position to retain the juvenile seat in a releasable stationary erected position relative to the seat foundation, and the upper anchor-receiver socket is located to receive and retain the free end of the anchor therein upon folding of the high chair to assume the flat-fold collapsed storage position to retain the juvenile seat in a releasable stationary knock-down position.

13. The foldable high chair of claim 12, wherein the seat lock further includes an anchor-release unit including a lever coupled to the anchor, a rod mount coupled to the juvenile seat, and a pivot rod coupled to the rod mount to establish a lever pivot axis and coupled to the lever to support the lever for pivotable movement about the lever pivot axis between a first position wherein the free end of the anchor is withdrawn from each of the lower and upper anchor-receiver sockets and free to move back and forth in the anchor-travel channel and a second position wherein the free end of the anchor extends into a selected one of the lower and upper anchor-receiver sockets to block movement of the juvenile seat relative to the seat foundation.

14. A foldable high chair comprising a seat foundation including a front leg unit and a rear leg unit coupled to the front leg unit for pivotable movement about a leg pivot axis between a spread-apart position wherein a floor-engaging portion of the front leg unit is separated from a floor-engaging portion of the rear leg unit and a drawn-together position wherein the floor-engaging portions of the front and rear leg units lie in close proximity to one another and a juvenile seat mounted for movement on the seat foundation between an erected position and a knock-down position during pivotable movement of the front leg unit relative to the rear leg unit corresponding to folding and unfolding of the foldable high chair, wherein the juvenile seat is coupled to the front leg unit for pivotable movement about a seat pivot axis and to the rear leg unit for sliding movement along a portion of the rear leg unit in response to movement of the juvenile seat between the erected position and the knock-down position to cause the juvenile seat to assume the erected position and the seat foundation to assume the spread-apart position upon unfolding of the foldable high chair to assume an expanded use position and to cause the juvenile seat to assume the knock-down position and the seat foundation to assume the drawn-together position upon folding of the foldable high chair to assume a flat-fold collapsed storage position, wherein the juvenile seat includes an armrest unit coupled to the front leg unit for pivotable movement about the seat pivot axis, a seat bottom coupled to the front leg unit for pivotable movement about a front seat bottom pivot axis, and an extensible crotch bar coupled to each of the armrest unit and the seat bottom.

15. The foldable high chair of claim 14, wherein the extensible crotch bar includes a lower section pivotably coupled to the seat bottom and an upper section pivotably coupled to the armrest unit and slidably coupled to the lower section.

16. The foldable high chair of claim 15, wherein the armrest unit includes a first arm coupled at an inner end thereof to the juvenile seat by a first inner arm pivot for pivotable movement about an armrest pivot axis, a first outer arm pivot coupled to an outer end of the first arm and pivotably coupled to a first front leg included in the front leg unit at the seat pivot axis, a second arm coupled at an inner end thereof to the juvenile seat by a second inner arm pivot for pivotable movement about the armrest pivot axis, and a second outer arm pivot coupled to an outer end of the second arm and pivotably coupled to a second front leg included in the front leg unit at the seat pivot axis, and wherein the armrest unit further includes a rail arranged to interconnect the outer ends of the first and second arms and pivotably coupled to the upper section of the extensible crotch bar.

* * * * *